US011933297B2

(12) United States Patent
Inaba et al.

(10) Patent No.: US 11,933,297 B2
(45) Date of Patent: Mar. 19, 2024

(54) SCROLL COMPRESSOR

(71) Applicant: SANDEN AUTOMOTIVE COMPONENTS CORPORATION, Isesaki (JP)

(72) Inventors: Hironobu Inaba, Isesaki (JP); Taizo Sato, Isesaki (JP); Tetsuya Imai, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 228 days.

(21) Appl. No.: 17/437,939

(22) PCT Filed: Mar. 16, 2020

(86) PCT No.: PCT/JP2020/011349
§ 371 (c)(1),
(2) Date: Sep. 10, 2021

(87) PCT Pub. No.: WO2020/189603
PCT Pub. Date: Sep. 24, 2020

(65) Prior Publication Data

US 2022/0170461 A1 Jun. 2, 2022

(30) Foreign Application Priority Data

Mar. 20, 2019 (JP) ..... 2019-052797

(51) Int. Cl.
*F04C 23/00* (2006.01)
*F04C 18/02* (2006.01)
(Continued)

(52) U.S. Cl.
CPC ..... *F04C 18/0215* (2013.01); *F04C 18/0261* (2013.01); *F04C 23/008* (2013.01); *F04C 28/28* (2013.01); *F04C 29/068* (2013.01); *F04C 2240/30* (2013.01)

(58) Field of Classification Search
CPC ..... F04C 18/0215; F04C 18/0261; F04C 18/0246; F04C 23/008; F04C 27/005; F04C 18/0253
See application file for complete search history.

(56) References Cited

U.S. PATENT DOCUMENTS

2005/0123428 A1* 6/2005 Uchida ..... F04C 27/005 418/55.4
2010/0158710 A1* 6/2010 Umemura ..... F04C 27/005 417/310

FOREIGN PATENT DOCUMENTS

CN 102207088 A 10/2011
JP 05-231354 A 9/1993
(Continued)

OTHER PUBLICATIONS

English WO-20211010099 by PE2E, Jun. 20, 2023.*
(Continued)

*Primary Examiner* — Deming Wan
(74) *Attorney, Agent, or Firm* — Baker Botts L.L.P.

(57) ABSTRACT

[Problem] A scroll compressor is provided which has improved workability when a back pressure chamber and a compression chamber are communicated with each other.

[Solution] A scroll compressor 1 includes a back pressure chamber 39 formed in a back surface of a mirror plate 31 of a movable scroll 22 in the scroll compressor 1, and a communication hole 51 which is formed in the mirror plate 31 of the movable scroll 22 and communicates the back pressure chamber 39 and a compression chamber 34 with each other. The communication hole 51 is constituted of a large-diameter hole section 52 located on the back pressure chamber 33 side of the mirror plate 31 of the movable scroll
(Continued)

22, and a small-diameter hole section 53 which continues from the large-diameter hole section 52 to reach the compression chamber 34.

11 Claims, 3 Drawing Sheets

(51) Int. Cl.

| | |
|---|---|
| ***F04C 27/00*** | (2006.01) |
| ***F04C 28/28*** | (2006.01) |
| ***F04C 29/06*** | (2006.01) |

(56) References Cited

FOREIGN PATENT DOCUMENTS

| | | | | | |
|---|---|---|---|---|---|
| JP | 2006-063943 | A | | 3/2006 | |
| JP | 2007-064147 | A | | 3/2007 | |
| JP | 2009-299523 | A | | 12/2009 | |
| JP | 2009299523 | A | * | 12/2009 | ..... F04C 18/02 |
| JP | 5859480 | B2 | | 2/2016 | |
| WO | WO-2021010099 | A1 | * | 1/2021 | ..... F04C 18/0215 |

OTHER PUBLICATIONS

English translation of JP2009299523 by PE2E Sep. 11, 2023.*
Japan Patent Office, International Search Report issued in International Application No. PCT/JP2020/011349, dated Jun. 2, 2020.
Chinese Office Action dated Oct. 10, 2022, Chinese Application No. 202080021411.2.

* cited by examiner

SCROLL COMPRESSOR

CROSS-REFERENCE TO RELATED APPLICATIONS

This application is a U.S. National Stage Patent Application under 37 U.S.C. § 371 of International Patent Application No. PCT/JP2020/011349, filed on Mar. 16, 2020, which claims the benefit of Japanese Patent Application No. JP 2019-052797, filed on Mar. 20, 2019, the disclosures of each of which are incorporated herein by reference in their entirety.

TECHNICAL FIELD

The present invention relates to a scroll compressor which compresses a working fluid in a compression chamber formed between laps of both a fixed scroll and a movable scroll by revolving and turning the movable scroll with respect to the fixed scroll.

BACKGROUND ART

This type of scroll compressor conventionally includes a compression mechanism constituted of a fixed scroll having a spiral lap on the surface of a mirror plate and a movable scroll having a spiral lap on the surface of a mirror plate and is configured in such a manner that a compression chamber is formed between the laps of the respective scrolls with the laps facing each other, and the movable scroll is revolved and turned with respect to the fixed scroll by a motor to thereby compress a working fluid (refrigerant).

In this case, a back pressure chamber for pressing the movable scroll against the fixed scroll against a compression reaction force from the compression chamber is formed in the back surface of the mirror plate of the movable scroll. Conventionally, a back pressure passage causing the discharge side (discharge space) of the compression mechanism and the back pressure chamber to communicate with each other is formed, and an orifice is arranged in this back pressure passage, whereby discharge pressure after being decompressed by the orifice is supplied to the back pressure chamber to apply a back pressure load which overcomes the compression reaction force to the movable scroll (refer to, for example, Patent Document 1).

Further, in Patent Document 1, a hole for pressure control is formed in the mirror plate of the movable scroll. With the formation of this hole, oil having flowed into the back pressure chamber from the back pressure passage can be returned to the compression chamber, and for example, in an operating state where suction pressure is low, the pressure (back pressure) in the back pressure chamber can be adjusted not to be excessive.

CITATION LIST

Patent Document

Patent Document 1: Japanese Patent No. 5859480

SUMMARY OF THE INVENTION

Problems to be Solved by the Invention

Here, when the hole tor pressure control is formed in the mirror plate of the movable scroll as in Patent Document 1, it is necessary to prevent communication by the hole between the outer compression chamber and the inner compression chamber adjacent to each other through the lap of the fixed scroll. Further, since the hole communicates the compression chamber and the back pressure chamber with each other to adjust the pressure, the inner diameter thereof becomes relatively small so that the hole has a squeezing function.

FIG. 5 shows a cross section of a conventional movable scroll at a portion of a hole for pressure control. In the figure, 100 is a movable scroll, 101 is a mirror plate of the movable scroll 100, 102 is a lap, and 103 is the above hole for pressure control. In this case, since the hole 103 must penetrate the mirror plate 101, its length dimension (depth dimension) becomes relatively large (long). Further, the hole 103 is excavated with a machining blade for drilling upon forming the hole 103, but since the inner diameter of the hole 103 is small as described above, it is cut with a fine machining blade. Therefore, there were problems such as time being taken, the machining blade being easily damaged, and the need for a special blade.

The present invention has been made to solve such conventional technical problems, and an object thereof is to provide a scroll compressor which has improved workability when communicating a back pressure chamber and a compression chamber with each other.

Means for Solving the Problems

A scroll compressor of the invention of claim 1 includes a compression mechanism constituted of a fixed scroll and a movable scroll respectively formed at surfaces of mirror plates with spiral laps facing each other and is characterized in that the movable scroll is revolved and turned with respect to the fixed scroll to thereby compress a working fluid in a compression chamber formed between the laps of both scrolls. The scroll compressor is characterized by including a back pressure chamber formed in a back surface of the mirror plate of the movable scroll and a communication hole formed in the mirror plate of the movable scroll and communicating the back pressure chamber and the compression chamber with each other, and in that the communication hole is constituted of a large-diameter hole section located on the back pressure chamber side of the mirror plate of the movable scroll and a small-diameter hole section continuously extending from the large-diameter hole section to the compression chamber.

The scroll compressor of the invention of claim 2 is characterized in that in the above invention, the length dimension of the small-diameter hole section is smaller than the length dimension of the large-diameter hole section.

A scroll compressor of the invention of claim 3 includes a compression mechanism constituted of a fixed scroll and a movable scroll respectively formed at surfaces of mirror plates with spiral laps facing each other and is characterized in that the movable scroll is revolved and turned with respect to the fixed scroll to thereby compress a working fluid in a compression chamber formed between the laps of both scrolls. The scroll compressor is characterized by including a back pressure chamber formed in a back surface of the mirror plate of the movable scroll, a mounting hole formed in the mirror plate of the movable scroll and extending from the back pressure chamber to the compression chamber, and a communication member installed in the mounting hole and in that the communication member has a communication section which communicates the back pressure chamber and the compression chamber with each other.

The scroll compressor of the invention of claim 4 is characterized in that in the above invention, the communication member has a tubular shape, and the communication section is constituted by a through hole which communicates the back pressure chamber and the compression chamber with each other.

The scroll compressor of the invention of claim 5 is characterized in that in the invention of claim 3 or 4, the mounting hole is constituted of a large-diameter hole section located on the back pressure chamber side of the mirror plate of the movable scroll, and a small-diameter hole section which continues from the large-diameter hole section to reach the compression chamber, and the communication member is mounted in the large-diameter hole section of the mounting hole.

The scroll compressor of the invention of claim 6 is characterized in that in the above respective inventions, the inner diameter of the small-diameter hole section or the communication section is smaller than the width of the lap of the fixed scroll.

The scroll compressor of the invention of claim 7 is characterized in the above respective inventions by including a back pressure passage which communicates the discharge side of the compression mechanism and the back pressure chamber with each other, and a pressure reducing section provided in the back pressure passage.

Advantageous Effect of the Invention

According to the invention of claim 1, in a scroll compressor which includes a compression mechanism constituted of a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls, a back pressure chamber is formed in a back surface of the mirror plate of the movable scroll, and a communication hole communicating the back pressure chamber and the compression chamber with each other is formed in the mirror plate of the movable scroll and is constituted of a large-diameter hole section located on the back pressure chamber side of the mirror plate of the movable scroll and a small-diameter hole section continuously extending from the large-diameter hole section to the compression chamber. Therefore, when the communication hole communicating the back pressure chamber and the compression chamber with each other is formed in the mirror plate of the movable scroll, it becomes sufficient to machine only the small-diameter hole section of the communication hole with a thin machining blade and machine the large-diameter hole section with a relatively thick machining blade.

Consequently, the workability of the communication hole which communicates the back pressure chamber and the compression chamber with each other can be significantly improved. In particular, by making the length dimension of the small-diameter hole section smaller than that of the large-diameter hole section as in the invention of claim 2, the workability becomes even better.

Further, according to the invention of claim 3, in a scroll compressor which includes a compression mechanism constituted of a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls, a back pressure chamber is formed in a back surface of the mirror plate of the movable scroll, and a mounting hole extending from the back pressure chamber to the compression chamber is formed in the mirror plate of the movable scroll, and a communication member is installed in the mounting hole and provided with a communication section which communicates the back pressure chamber and the compression chamber with each other. Therefore, it is not necessary to machine the mirror plate of the movable scroll with the thin machining blade for the purpose of communicating the back pressure chamber and the compression chamber with each other.

That is, for example, since it becomes sufficient to form a through hole in the tubular communication member to shape into a communication section as in the invention of claim 4, the workability of the movable scroll for communicating the back pressure chamber and the compression chamber can be remarkably improved.

In this case, as in the invention of claim 5, the mounting hole is constituted of a large-diameter hole section located on the back pressure chamber side of the mirror plate of the movable scroll and a small-diameter hole section which continues from the large-diameter hole section to reach the compression chamber, and the communication member is mounted in the large-diameter hole section of the mounting hole. Consequently, the communicating member is not exposed on the surface of the mirror plate of the movable scroll and its positioning becomes easy.

Further, as in the invention of claim 6, the inner diameter of the above-described small-diameter hole section or communication section is made smaller than the width of the lap of the fixed scroll, thereby making it possible to prevent even inconvenience that the outer compression chamber and the inner compression chamber adjacent to each other via the lap of the fixed scroll are communicated with each other by the small-diameter hole section or the communication section.

Then, the above inventions are extremely effective when the pressure on the discharge side is reduced in the back pressure passage and applied to the back pressure chamber as in the invention of claim 7.

MODE FOR CARRYING OUT THE INVENTION

Hereinafter, embodiments of the present invention will be described in detail with reference to the drawings.

Embodiment 1

Figure 1:
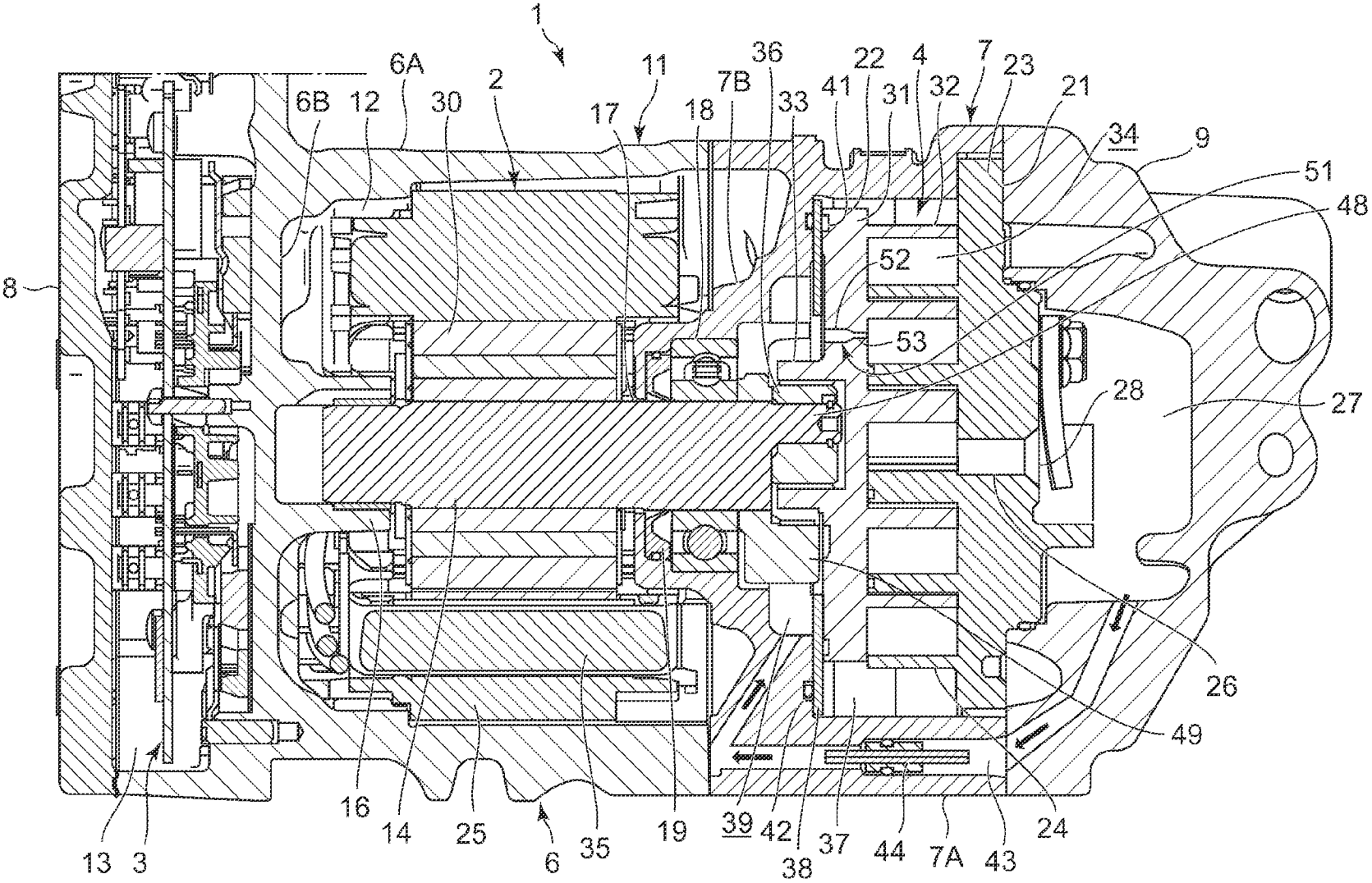
FIG. 1 is a cross-sectional view of a scroll compressor of an embodiment to which the present invention is applied.

FIG. 1 is a cross-sectional view of a scroll compressor 1 of an embodiment to which the present invention is applied.

The scroll compressor 1 of the embodiment is, for example, a so-called inverter-integrated scroll compressor which is used in a refrigerant circuit of a vehicle air conditioning device sucks a carbon dioxide refrigerant as a working fluid of the vehicle air conditioning device, and compresses and discharges it, and which includes an electric motor 2, an inverter 3 for operating the electric motor 2, and a compression mechanism 4 driven by the electric motor 2.

The scroll compressor 1 of the embodiment includes a main housing 6 which accommodates the electric motor 2 and the inverter 3 thereinside, a compression mechanism housing 7 which accommodates the compression mechanism 4 thereinside, an inverter cover 8, and a compression mechanism cover 9. Then, the main housing 6, the compression mechanism housing 7 the inverter cover 8, and the compression mechanism cover 9 are all made of metal (made of aluminum in the embodiment). They are integrally joined to constitute a housing 11 of the scroll compressor 1.

The main housing 6 is constituted of a tubular peripheral wall portion 6A and a partition wall portion 65. The partition wall portion 6B a partition wall which partitions the inside of the main housing 6 into a motor accommodating portion 12 accommodating the electric motor 2 and an inverter accommodating portion 13 accommodating the inverter 3. One end surface of the inverter accommodating portion 13 is open, and this opening is closed by the inverter cover 3 after the inverter 3 is accommodated therein.

The other end surface of the motor accommodating portion 12 is also open, and this opening is closed by the compression mechanism housing 7 after the electric motor 2 is accommodated therein. A support portion 16 for supporting one end portion (end portion on the side opposite to the compression mechanism 4) of a rotating shaft 14 of the electric motor 2 is protrusively provided at the partition wall portion 6B.

The compression mechanism housing 7 has an opening on the side opposite to the main housing 6, and this opening is closed by the compression mechanism cover 9 after the compression mechanism 4 is accommodated therein. The compression mechanism housing 7 is constituted of a tubular peripheral wall portion 7A and a frame portion 73 on one end side (main housing 6 side) thereof. The compression mechanism 4 is accommodated in a space partitioned by the peripheral wall portion 7A and the frame portion 73. The frame portion 7*b* forms a partition wall which partitions the inside of the main housing 6 from the inside of the compression mechanism housing 7.

Further, the frame portion 7B is provided with a through hole 17 to insert the other end of the rotating shaft 14 of the electric motor 2 (the end on the compression mechanism 4 side). A front bearing 18 as a bearing member, which supports the other end of the rotating shaft 14, is fitted to the compression mechanism 4 side of the through hole 17. Further, reference numeral 19 denotes a seal material which seals the outer peripheral surface of the rotating shaft 14 and the inside of the compression mechanism housing 7 at the portion of the through hole 17.

The electric motor 2 is constituted of a stator 25 around which a coil 35 is wound and a rotor 30. Then, for example, a direct current, from a battery (not shown) of a vehicle is converted into a three-phase alternating current by the inverter 3, which is supplied to the coil 35 of the electric motor 2, so that the rotor 30 is configured to be rotationally driven.

Further, an unillustrated suction port is formed in the main housing 6. After the refrigerant sucked from the suction port passes through the inside of the main housing 6, the refrigerant is sucked into a suction portion 37 to be described later outside the compression mechanism 4 in the compression mechanism housing 7. Consequently, the electric motor 2 is cooled by the sucked refrigerant. In addition, the refrigerant compressed by the compression mechanism 4 is configured to be discharged from a discharge space 27 described later as a discharge side of the compression mechanism 4 through an unillustrated discharge port formed in the compression mechanism cover 9.

The compression mechanism 4 is constituted of a fixed scroll 21 and a movable scroll 22. The fixed scroll 21 integrally has a disk-shaped mirror plate 23 and a spiral lap 24 comprised of an involute shape or a curved line approximated thereto, which stands on the surface (one surface) of the mirror plate 23. The surface of the mirror plate 23 on which the lap 24 is vertically provided is fixed to the compression mechanism housing 7 as the frame portion 7B side. A discharge hole 26 is formed in the center of the mirror plate 23 of the fixed scroll 21. The discharge hole 26 communicates with the discharge space 27 in the compression mechanism cover 9. Reference numeral 28 denotes a discharge valve provided in the opening on the back surface (the other surface) side of the mirror plate 23 in the discharge hole 26.

The movable scroll 22 is a scroll which revolves and turns with respect to the fixed scroll 21, and integrally includes a disk-shaped mirror plate 31, a spiral lap 32 comprised of an involute shape or a curved line approximated thereto, which stands on the surface (one surface) of the mirror plate 31, and a boss portion 33 formed to protrude in the center of the back surface (the other surface) of the mirror plate 31. The movable scroll 22 is arranged so that the lap 32 faces the lap 24 of the fixed scroll 21 and they face each other and mesh with each other with the protruding direction of the lap 32 as the fixed scroll 21 side, and a compression chamber 34 is formed between the laps 24 and 32.

That is, the lap 32 of the movable scroll 22 faces the lap 24 of the fixed scroll 21 and meshes with the lap 24 so that the tip of the lap 32 comes into contact with the surface of the mirror plate 23 and the tip of the lap 24 comes into contact with the surface of the mirror plate 31. The other end of the rotating shaft 14, that is, the end on the movable scroll 22 side is provided with a columnar drive protrusion 43 which protrudes at a position eccentric from the axial center of the rotating shaft 14. Then, a columnar, eccentric bush 36 is also attached to the drive protrusion 43 and provided eccentrically from the axial center of the rotating shaft 14 at the other end of the rotating shaft 14.

In this case, the eccentric bush 36 is attached to the drive protrusion 43 at a position eccentric from the axial center of the eccentric bush 36. The eccentric bush 36 is fitted to the boss portion 33 of the movable scroll 22. Then, when the rotating shaft 14 is rotated together with the rotor 30 of the electric motor 2, the movable scroll 22 is configured to revolve and turn with respect to the fixed scroll 21 without rotating on its axis. Incidentally, reference numeral 49 denotes a balance weight attached to the outer peripheral surface of the rotating shaft 14 on the movable scroll 22 side from the front bearing 18.

Since the movable scroll 22 revolves and turns eccentrically with respect to the fixed scroll 21, the eccentric direction and the contact position of each of the laps 24 and 32 are moved while rotating, and the compression chamber 34 having sucked the refrigerant from the above-mentioned suction portion 37 on the outside gradually shrinks while moving toward the inside. Consequently, the refrigerant is compressed and finally discharged from the central discharge hole 26 to the discharge space 27 through the discharge valve 28.

In FIG. 1, reference numeral 36 is an annular thrust plate. The thrust plate 33 is for partitioning a back pressure chamber 39 formed in the back surface side of the mirror plate 31 of the movable scroll 22 and the suction portion 37 as a suction pressure region outside the compression mechanism 4 in the compression mechanism housing 7. The thrush plate 38 is located outside the boss portion 33 and interposed between the frame portion 7B and the movable scroll 22. Reference numeral 41 is a seal material which is attached to the back surface of the mirror plate 31 of the movable scroll 22 and abuts against the thrust plate 38. The back pressure chamber 39 and the suction portion 37 are partitioned by the seal material 41 and the thrust plate 38.

Incidentally/reference numeral 42 is a seal material which is attached to the surface of the frame portion 7B on the thrust plate 38 side, abuts against the outer peripheral portion of the thrust plate 38, and seals between the frame portion 7B and the thrust plate 38.

Further, in FIG. 1, reference numeral 43 denotes a back pressure passage formed from the compression mechanism cover 9 to the compression mechanism housing 7. An orifice 44 as a pressure reducing section is installed in the back pressure passage 43. The back pressure passage 43 causes the inside of the discharge space 27 (the discharge side of the compression mechanism 4) in the compression mechanism cover 9 and the back pressure chamber 39 to communicate with each other, whereby as shown by an arrow in FIG. 1, the back pressure passage 43 is configured so that oil having discharge pressure adjusted to be reduced in pressure by the orifice 44 is mainly supplied to the back pressure chamber 39.

The pressure (back pressure) in the back pressure chamber 39 causes a back pressure load which presses the movable scroll 22 against the fixed scroll 21. Due to this back pressure load, the movable scroll 22 is pressed against the fixed scroll 21 against a compressive reaction force from the compression chamber 34 of the compression mechanism 4, so that the contacts between the laps 24 and 32 and the mirror plates 31 and 23 are maintained, thereby making it possible to compress the refrigerant in the compression chamber 34.

Further, in this embodiment, a communication hole 51 is cut in the mirror plate 31 of the movable scroll 22. The communication hole 51 is a hole for pressure control which communicates the back pressure chamber 39 on the back surface side of the mirror plate 31 of the movable scroll 22 and the compression chamber 34 on the front surface side of the mirror plate 31 with each other. For example, in an operating state with low suction pressure, the communication hole 51 acts to release the pressure (back pressure) in the back pressure chamber 39 to the compression chamber 34 so that the back pressure does not become excessive. In addition, the oil in the back pressure chamber 39 is also returned to the compression chamber 34 at this time. This is extremely effective when the pressure in the discharge space 27 is reduced by the orifice 44 in the back pressure passage 43 and applied to the back pressure chamber 39 as in the embodiment.

Figure 2:
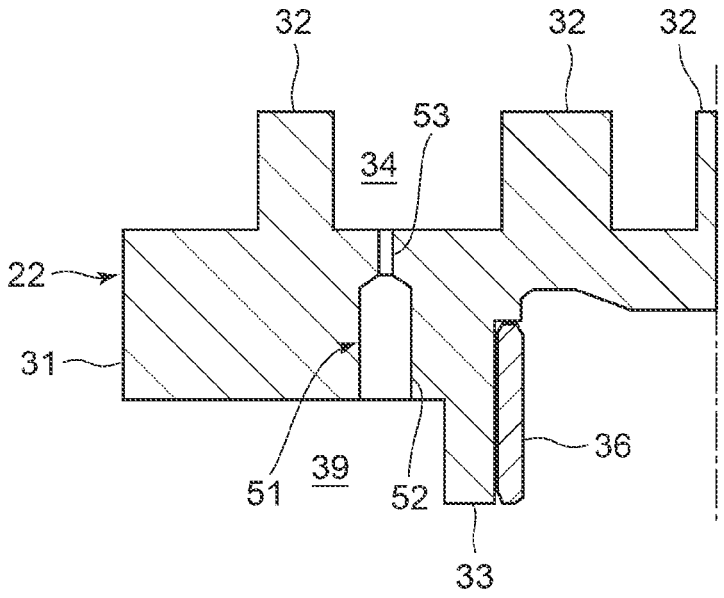
FIG. 2 is an enlarged cross-sectional view of a movable scroll of the scroll compressor of FIG. 1 at a portion of a communication hole (Embodiment 1)

Next, the shape of the above communication hole 51 and the procedure for its formation will be described with reference to FIG. 2. The communication hole 51 of this embodiment is constituted of a large-diameter hole section 52 located on the back pressure chamber 39 side of the mirror plate 31, and a small-diameter hole section 53 which continuously reaches the compression chamber 34 on the front surface side of the mirror plate 31 from the large-diameter hole section 52. The inner diameter of the small-diameter hole section 53 is smaller than the width of the lap 24 of the fixed scroll 21, and the large-diameter hole section 52 has a larger inner diameter than the small-diameter hole section 53. Further, in the embodiment, the length dimension of the small-diameter hole section 53 is made smaller than the length dimension of the large-diameter hole section 52.

Upon forming the communication hole 51 in the mirror plate 31, first, the mirror plate 31 is shaved from the back surface side of the mirror plate 31 with a relatively thick (large diameter) machining blade to form the large-diameter hole section 52. Next, a relatively thin (small diameter) machining blade is inserted into the large-diameter hole section 52, and the bottom of the large-diameter hole section 52 is shaved to the front surface side of the mirror plate 31 to form the small-diameter hole section 53. With this, a sequential communication hole 51 which communicates the back pressure chamber 39 and the compression chamber 31 with each other is formed through the mirror plate 31.

Thus, when the communication hole 51 that communicates the back pressure chamber 39 and the compression chamber 34 with each other is formed in the mirror plate 31 of the movable scroll 22, the communication hole 51 is constituted of the large-diameter hole section 52 located on the back pressure chamber 39 side of the mirror plate 31 of the movable scroll 22 and the small-diameter hole section 53 which continuously reaches the compression chamber 34 from the large-diameter hole section 52, whereby upon forming the communication hole 51 communicating the back pressure chamber 39 and the compression chamber 34 with each other in the mirror plate 31 of the movable scroll 22, only the small-diameter hole section 53 of the communication hole 51 may be machined with a thin machining blade, and the large-diameter hole section 52 may be machined with a relatively thick machining blade.

Consequently, the workability of the communication hole 51 which communicates the back pressure chamber 39 and the compression chamber 34 with each other can be significantly improved. In particular, by making the length dimension of the small-diameter hole section 53 smaller than that of the large-diameter hole section 52 as in the embodiment, the workability becomes even better. Further, by making the inner diameter of the small-diameter hole section 53 smaller than the width of the lap 24 of the fixed scroll 21 as in the embodiment, it is possible to prevent even inconvenience that the outer compression chamber 34 and the inner compression chamber 34 adjacent to each other via the lap 24 of the fixed scroll 21 are communicated with each other by the small-diameter hole section 53 of the communication hole 51.

Embodiment 2

Figure 3:
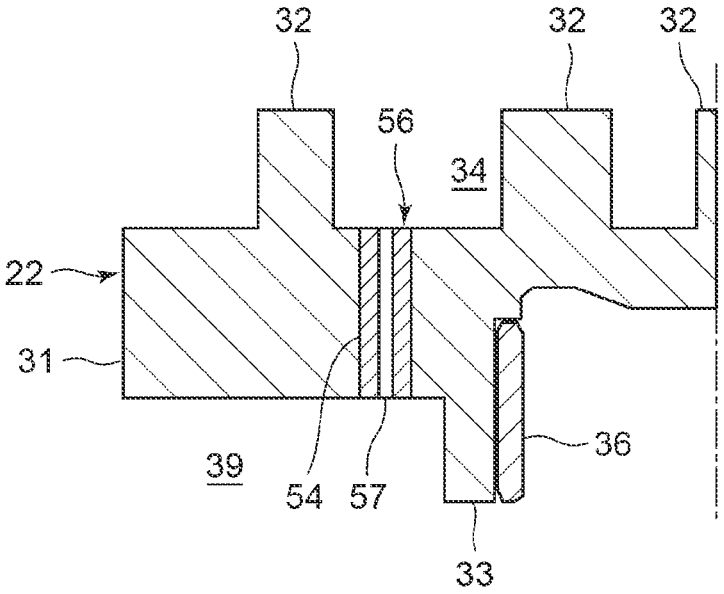
FIG. 3 is an enlarged cross-sectional view of the movable scroll of the scroll compressor of FIG. 1 at a portion of a communication member (Embodiment 2)

Next, another embodiment (Embodiment 2) of the present Invention will be described with reference to FIG. 3. In the case of this embodiment, instead of the communication hole 51 in FIGS. 1 and 2, a mounting hole 54 extending from the back pressure chamber 39 to the compression chamber 34 is formed through the mirror plate 31 of the movable scroll 22. A communication member 56 is installed in the mounting hole 54. Incidentally, the other structures are similar to the case of FIG. 1.

In this case, the mounting hole 54 is a hole having a relatively large diameter, and the communication member 56 has a tubular shape (pipe shape) in the embodiment and has a communication section 57 formed of a through hole having a relatively small diameter in its axial center. Then, the inner diameter of the communication section 57 is smaller than the width of the lap 24 of the fixed scroll 21. The communication member 56 is installed in the mounting hole 54 of the mirror plate 31 by being press-fitted, or thread-engaged with a screw groove on the side surface, or caulking.

As in this embodiment, as long as the mounting hole 54 extending from the back pressure chamber 39 to the compression chamber 34 is formed in the mirror plate 31 of the movable scroll 22, and the communication member 56 is mounted in the mounting hole 54 and provided with the communication section 57 which communicates the back pressure member 39 and the compression chamber 34 with each other, it is not necessary to machine the mirror plate 31 of the movable scroll 22 with the thin machining blade for the purpose of communicating the back pressure chamber 39 and the compression chamber 34 with each other.

That is, since it is sufficient to form the through hole in the tubular communication member 56 to shape into the Communication section 57 as in the embodiment, the workability of the movable scroll 22 for communicating the back pressure chamber 39 and the compression chamber 34 with each other can be remarkably improved. Further, by making the inner diameter of the communication section 57 smaller than the width of the lap 24 of the fixed scroll 21 as in the embodiment, it is possible to prevent even inconvenience that the outer compression chamber 34 and the inner compression chamber 34 adjacent to each other via the lap 24 of the fixed scroll 21 are communicated with each other by the communication section 57 of the communication member 56.

Incidentally, in the embodiment, the communication member 56 is used as the tubular member to form the communication section 57 through the through hole at its axial center, but the present invention is not limited thereto. For example, an axial fine groove is formed in the side surface of the communication member 56, and the communication section 57 may be formed by the groove and the mounting hole 54.

Embodiment 3

Figure 4:
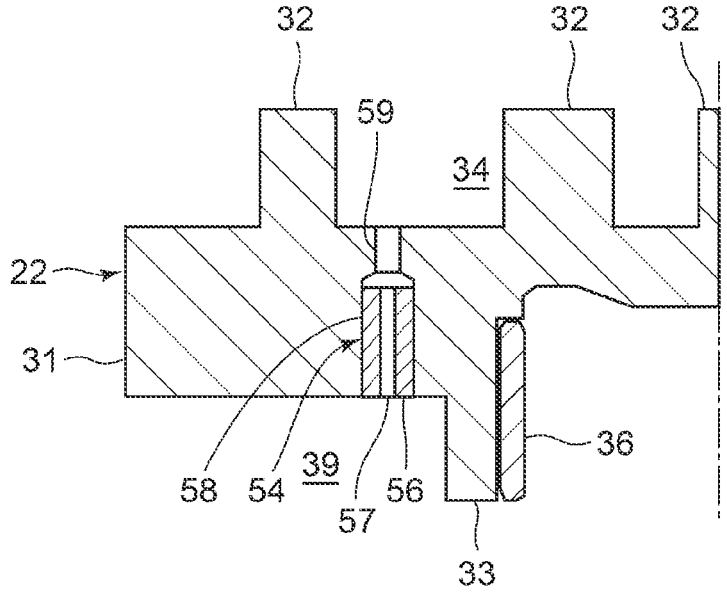
FIG. 4 is another enlarged cross-sectional view of the movable scroll of the scroll compressor of FIG. 1 at a portion of the communication member (Embodiment 3)
Figure 5:
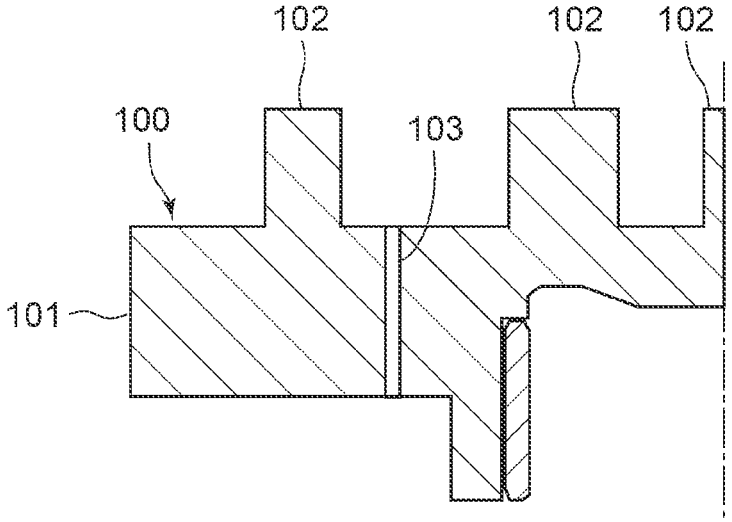
FIG. 5 is an enlarged cross-sectional view of a movable scroll of a conventional scroll compressor at a hole portion for pressure control.

Next, a further embodiment (Embodiment 3) of the present invention will be described with reference to FIG. 4. In the case of this embodiment as well, instead of the communication hole 51 in FIGS. 1 and 2, a mounting hole 54 extending from the back pressure chamber 39 to the compression chamber 34 is formed through the mirror plate 31 of the movable scroll 22 in a manner similar to the case of FIG. 3. The communication member 56 is mounted in the mounting hole 54. Further, the other structures are similar to the case of FIG. 1.

However, in this case, the mounting hole 54 is constituted of a large-diameter hole section 58 located on the back pressure chamber 39 side of the mirror plate 31 and a small-diameter hole section 59 continuous from the large-diameter hole section 58 and reaching the compression chamber 34 on the front surface side of the mirror plate 31. The inner diameter of the small-diameter hole section 59 in the embodiment is larger than the inner diameter of the small-diameter hole section 53 of FIG. 2, but is still smaller than the width of the lap 24 of the fixed scroll 21. Further, the inner diameter of the large-diameter hole section 50 is larger than that of the small-diameter hole section 59 and is made similar to the inner diameter of the mounting hole 54 in FIG. 3.

Further, in the embodiment, the length dimension of the small-diameter hole section 59 is made smaller than the length dimension of the large-diameter hole section 59. In addition, the structure of the communication member 56 is similar to the case of FIG. 3, but the length dimension thereof is made short, and the communication member 56 can be stored in the large-diameter hole section 59 of the mounting hole 54 in FIG. 4.

Upon forming the mounting hole 54 in this embodiment in the mirror plate 31, first, the mirror plate 31 is shaved from the back surface side of the mirror plate 31 with a relatively thick (large diameter) machining blade to form the large-diameter hole section 58. Next, a machining blade thinner than this is inserted into the large-diameter hole section 58 to shave the bottom of the large-diameter hole section 58 to the front surface side of the mirror plate 31 to form the small-diameter hole portion 59, whereby the sequential mounting hole 54 extending from the back pressure chamber 39 to the compression chamber 34 is formed through the mirror plate 31.

Next, the communication member 56 (short in size) of this embodiment is attached by being press-fitted into the large-diameter hole section 58 of the mounting hole 54 from the back surface side of the mirror plate 31, or being thread-engaged with the screw groove on the side surface, or caulking.

Even if the present invention is made as in this embodiment, it is not necessary to machine the mirror plate 31 of the movable scroll 22 with the thin machining blade for the purpose of communicating the back pressure chamber 39 and the compression chamber 34 with each other in a manner similar to the case of Embodiment 2. That is, since it is sufficient to form the through hole in the tubular communication member 56 to shape into the communication section 57 as in the embodiment, the workability of the movable scroll 22 for communicating the back pressure chamber 39 and the compression chamber 34 with each ether can be remarkably improved. Further, by making the inner diameter of the small-diameter hole section 59 smaller than the width of the lap 24 of the fixed scroll 21 as in the embodiment, it is possible to prevent even inconvenience that the outer compression chamber 34 and the inner compression chamber 34 adjacent to each other via the lap 24 of the fixed scroll 21 are communicated with each other by the small-diameter hole section 59 of the mounting hole 54.

In particular, as in this embodiment, the mounting hole 54 is constituted of the large-diameter hole section 58 located on the back pressure chamber 39 side of the mirror plate 31 of the movable scroll 22 and the small-diameter hole section 59 continuous from the large-diameter hole section 53 and reaching the compression chamber 34, and the communication member 56 is mounted in the large-diameter hole section 58 of the mounting hole 54. Consequently, the communication member 56 is not exposed on the front surface side (lap 32 side) of the mirror plate 31 of the movable scroll 22, and its positioning becomes easy.

Incidentally, in the case of this embodiment as well, as in the case of the second embodiment, for example, an axial fine groove is formed in the side surface of the communicating member 56, and the communication section 57 may be formed by the groove and the large-diameter hole section 58 of the mounting hole 54.

Incidentally, in the embodiment, the present invention is applied to the scroll compressor used in the refrigerant circuit of the vehicle air conditioning device, but is not limited thereto. The present invention is effective for a scroll compressor used in refrigerant circuits of various refrigerating devices. Further, in the embodiment, the present invention is applied to the so-called inverter-integrated scroll compressor, but is not limited thereto.

The present invention can also be applied to a normal scroll compressor which is not integrally provided with an inverter.

DESCRIPTION OF REFERENCE NUMERALS

1 scroll compressor
4 compression mechanism
14 rotating shaft
21 fixed scroll
22 movable scroll
23, 31 mirror plate
24, 32 lap
27 discharge space (discharge side)
34 compression chamber
39 back pressure chamber
43 back pressure passage
44 orifice (pressure reducing section)
51 communication hole
52, 58 large-diameter hole section
53, 59 small-diameter hole section
54 mounting hole
56 communication member
57 communication section.

The invention claimed is:

1. A scroll compressor which has a compression mechanism including a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls, comprising:

a back pressure chamber formed in a back surface of the mirror plate of the movable scroll;

a back pressure passage which communicates a discharge side of the compression mechanism and back pressure chamber with each other;

a pressure reducing section provided in the back pressure passage; and a communication hole formed in the mirror plate of the movable scroll and communicating the back pressure chamber and the compression chamber with each other, wherein the communication hole is constituted of a large-diameter hole section located on the back pressure chamber side of the mirror plate of the movable scroll and a small-diameter hole section continuously extending from the large-diameter hole section to the compression chamber.

2. The scroll compressor according to claim 1, wherein a length dimension of the small-diameter hole section is smaller than a length dimension of the large-diameter hole section.

3. The scroll compressor according to claim 2, wherein the inner diameter of the small-diameter hole section or the communication section is smaller than the width of the lap of the fixed scroll.

4. The scroll compressor according to claim 1, wherein the inner diameter of the small-diameter hole section or the communication section is smaller than the width of the lap of the fixed scroll.

5. A scroll compressor which has a compression mechanism including a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls, comprising:

a back pressure chamber formed in a back surface of the mirror plate of the movable scroll;

a back pressure passage which communicates a discharge side of the compression mechanism and the back pressure chamber with each other;

a pressure reducing section provided in the back pressure passage; a mounting hole formed in the mirror plate of the movable scroll and extending from the back pressure chamber to the compression chamber, and a communication member installed in the mounting hole, wherein the communication member has a communication section which communicates the back pressure chamber and the compression chamber with each other.

6. The scroll compressor according to claim 5, wherein the communication member has a tubular shape, and the communication section is configured by a through hole which communicates the back pressure chamber and the compression chamber with each other.

7. The scroll compressor according to claim 6, wherein the mounting hole is constituted of a large-diameter hole section located on the back pressure chamber side of the mirror plate of the movable scroll, and a small-diameter hole section which continues from the large-diameter hole section to reach the compression chamber, and wherein the communication member is mounted in the large-diameter hole section of the mounting hole.

8. The scroll compressor according to claim 6, wherein the inner diameter of the small-diameter hole section or the communication section is smaller than the width of the lap of the fixed scroll.

9. The scroll compressor according to claim 5, wherein the mounting hole is constituted of a large-diameter hole section located on the back pressure chamber side of the mirror plate of the movable scroll, and a small-diameter hole section which continues from the large-diameter hole section to reach the compression chamber, and wherein the communication member is mounted in the large-diameter hole section of the mounting hole.

10. The scroll compressor according to claim 9, wherein the inner diameter of the small-diameter hole section or the communication section is smaller than the width of the lap of the fixed scroll.

11. The scroll compressor according to claim 5, wherein the inner diameter of the small-diameter hole section or the communication section is smaller than the width of the lap of the fixed scroll.

* * * * *